US011626276B1

(12) United States Patent
Kreindel

(10) Patent No.: US 11,626,276 B1
(45) Date of Patent: Apr. 11, 2023

(54) REFLECTOR FOR INTENSE PULSE LIGHT DEVICE

(71) Applicant: Inmode Ltd., Yokneam (IL)

(72) Inventor: Michael Kreindel, Richmond Hill (CA)

(73) Assignee: Inmode Ltd., Yokneam (IL)

( * ) Notice: Subject to any disclaimer, the term of this patent is extended or adjusted under 35 U.S.C. 154(b) by 0 days.

(21) Appl. No.: 17/688,918

(22) Filed: Mar. 8, 2022

(51) Int. Cl.
*H01J 61/90* (2006.01)
*H01J 61/04* (2006.01)

(52) U.S. Cl.
CPC ..... *H01J 61/90* (2013.01); *H01J 61/045* (2013.01)

(58) Field of Classification Search
CPC ..... H01J 61/90; H01J 61/045
See application file for complete search history.

(56) References Cited

U.S. PATENT DOCUMENTS

2009/0234343 A1* 9/2009 Behrakis ..... A61B 18/203 606/9

* cited by examiner

*Primary Examiner* — Donald L Raleigh
(74) *Attorney, Agent, or Firm* — Dekel Patent Ltd.; David Klein

(57) ABSTRACT

An intense pulse light (IPL) device includes a flash lamp and a light guide for guiding light from the flash lamp to an area to be treated. The flash lamp includes an anode electrode and a cathode electrode, and an envelope defining a cavity. A reflector reflects light from the flash lamp to the area to be treated. At least one electrode protector has a reflecting surface that redirects light from the electrodes toward a center of the reflector.

8 Claims, 3 Drawing Sheets

REFLECTOR FOR INTENSE PULSE LIGHT DEVICE

FIELD OF THE INVENTION

The invention relates to intense pulse light (IPL) technology, and particularly to an IPL reflector that increases output energy and life time of the device.

BACKGROUND OF THE INVENTION

Intense pulse light (IPL) technology is known for the treatment of vascular lesions. The technology is based on irradiating skin surface with filtered light produced by flash lamp and directed to the output window by reflector. The energy is generated in pulse manner with typical pulse duration from 1 ms to 100 ms.

IPL technology was later improved by cooling the skin with transparent gel. In another development, spectrums of the light and pulse width have been modified for treatment of pigmented lesions and hair removal.

The main problem of IPL is that light generated by the flash lamp plasma is emitted in all directions and cannot be focused to a small spot. The spectrum of the flash lamp is very broad starting from UV light and ending in the infrared range. Most of the light spectrum is absorbed by a lamp quartz envelope or by the electrode or electrodes, which reduces the life time of lamp dramatically. Multiple reflections of photons inside the reflector also decrease energy output and increase light absorption inside the reflector assembly. Typical conversion of electrical energy to the optical output is in the range of 10-20%. Strong light absorption by the electrode material results in spattering of electrode material and its concretion on the lamp envelope that significantly reduces the life time of the lamp and limits the electrical energy.

SUMMARY

The present invention seeks to provide a device for delivering filtered optical energy from a flash lamp to the treated skin surface, as is described more in detail hereinbelow.

In one embodiment, the reflector surface may be made of a material that reflects part of the spectrum used for the treatment and absorbs the non-therapeutic part of spectrum. Typically, the ultraviolet spectrum and part of the visible spectrum (e.g., 400-550 nm) are not used in the treatment and are filtered. Absorption of this part of the lamp spectrum reduces the absorption by the electrodes and reduces heating and destruction of the electrodes. In the prior art, a typical reflector for IPL is coated with silver, which has a high reflection in a broad spectrum. In contrast, in the present invention, without limitation, gold coating or titanium nitride is used to absorb UV and part of the visible spectrum.

In another embodiment, the reflector, or a portion thereof, has an electrode protector with a shape that reflects the light from the electrode area toward the central part of the reflector, thereby minimizing exposure of electrodes.

Both embodiments can be combined to maximize output of optical energy and extend lamp life time.

BRIEF DESCRIPTION OF THE DRAWINGS

The present invention will be understood and appreciated more fully from the following detailed description taken in conjunction with the drawings in which.

DETAILED DESCRIPTION

Figure 1:
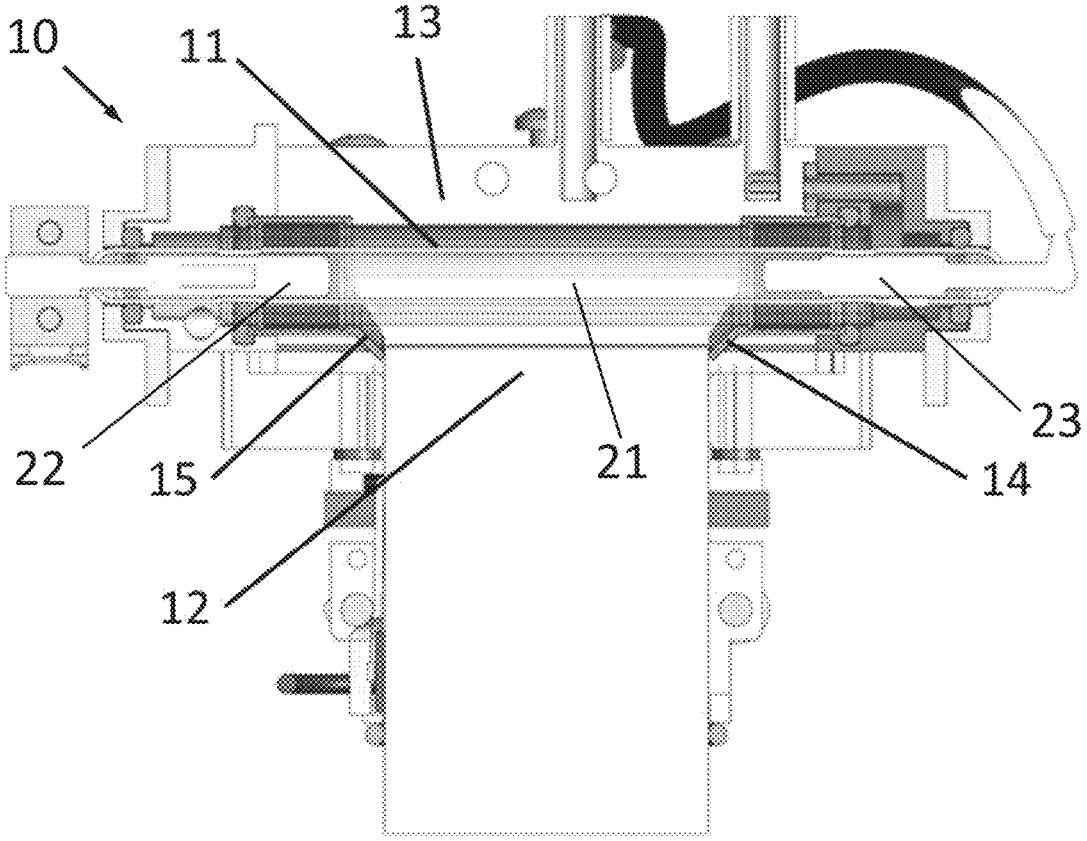
FIG. 1 is a simplified illustration of an intense pulse light (IPL) device, in accordance with a non-limiting embodiment of the present invention, including a reflector and a lamp assembly.

Reference is now made to FIG. 1, which illustrates an intense pulse light (IPL) device 10, in accordance with a non-limiting embodiment of the present invention.

Without limitation, IPL device 10 includes a flash lamp 11, which may be a linear flash lamp, and a light guide 12, which may be a sapphire light guide, for guiding the light from the flash lamp to the area to be treated.

Flash lamp 11 may include an anode electrode 22 and a cathode electrode 23, and an envelope 21 defining a cavity. The envelope 21 may be any material used in the manufacture of flash lamps (e.g., without limitation, a quartz envelope such as titanium-doped quartz). The cavity can be filled with any gas used in the manufacture of flash lamps (e.g., without limitation, xenon, krypton, or any combination thereof).

The IPL device 10 may include a reflector 13, which may be a water cooled reflector, for reflecting light from the flash lamp 11 to the area to be treated.

Figure 3:
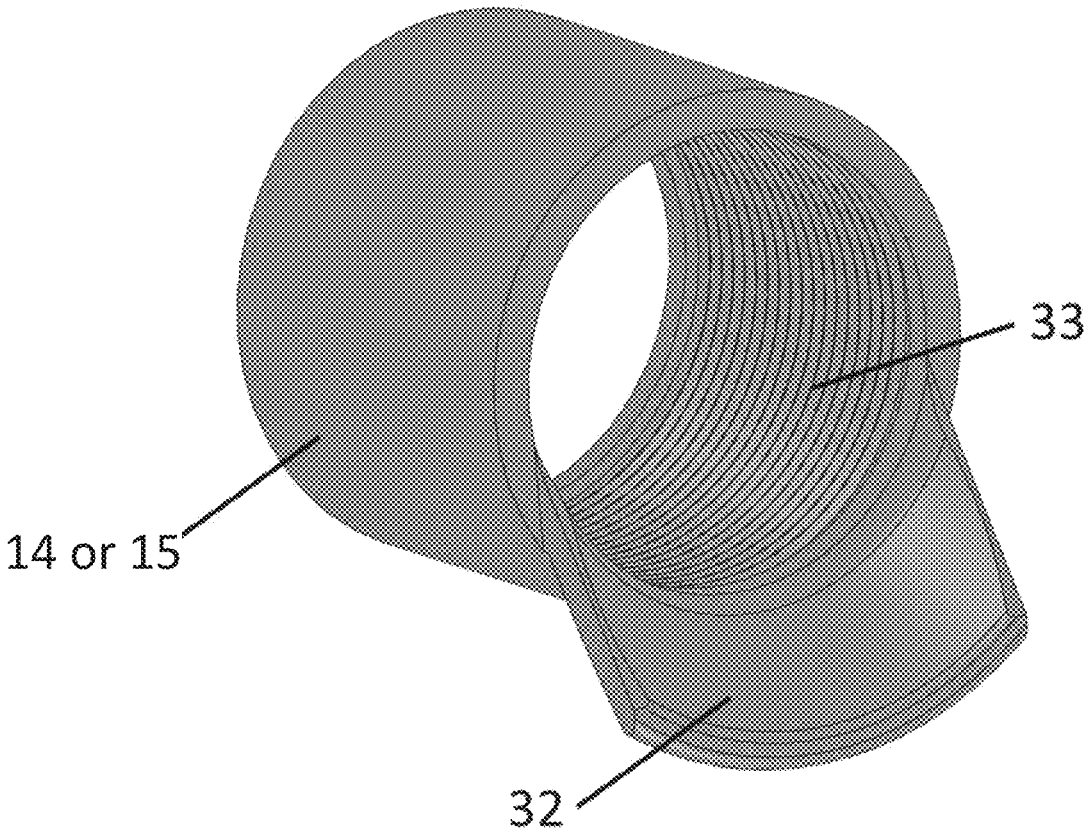
FIG. 3 is a simplified illustration of an electrode protector, in accordance with a non-limiting embodiment of the present invention.

In accordance with a non-limiting embodiment of the present invention, IPL device 10 may include one or more electrode protectors, such as electrode protectors 14 and 15. One non-limiting structure of the electrode protectors is shown in FIG. 3. The electrode protector may include a reflecting surface 32 that redirects light from the electrode area toward the center of the reflector. The electrode protector may include a non-smooth surface 33 that increases light absorption and reduces electrode exposure to light. The non-smooth surface 33 may include a series of circumferential grooves, for example.

Figure 2:
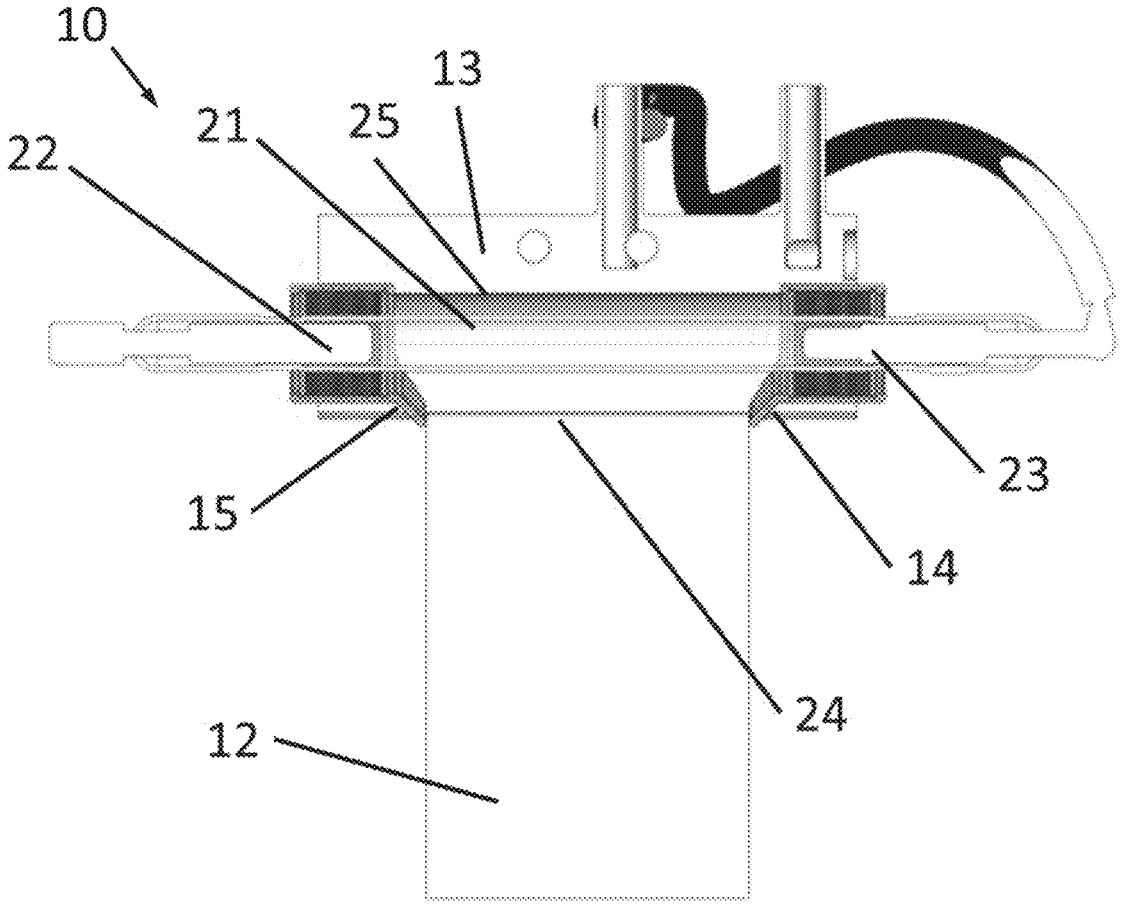
FIG. 2 is another illustration of the device with a selective reflector assembly, in accordance with a non-limiting embodiment of the present invention.

Reference is now made to FIG. 2, which illustrates the device with a selective reflector assembly, in accordance with a non-limiting embodiment of the present invention.

In this embodiment, a reflective filter 24 is disposed on the surface of light guide 12. Additionally or alternatively, a reflective coating 25 is disposed on the surface of reflector 13. In this embodiment, the reflector surface of reflective filter 24 or reflective coating 25 may be made of a material, such as without limitation, without limitation, gold coating or titanium nitride, which reflects part of the spectrum used for the treatment and absorbs the non-therapeutic part of spectrum. Typically, the ultraviolet spectrum and part of the visible spectrum (e.g., 400-550 nm) are not used in the treatment and are filtered. Absorption of this part of the lamp spectrum reduces the absorption by the electrodes and reduces heating and destruction of the electrodes.

What is claimed is:

1. An intense pulse light (IPL) device comprising:

a flash lamp and a light guide for guiding light from said flash lamp to an area to be treated, said flash lamp comprising an anode electrode and a cathode electrode, and an envelope defining a cavity;

a reflector configured to reflect light from said flash lamp to the area to be treated; and at least one electrode protector that comprises a reflecting surface that redirects light from said electrodes toward a center of said reflector.

2. The IPL device according to claim 1, wherein said at least one electrode protector comprises a non-smooth surface that increases light absorption and reduces electrode exposure to the light.

3. The IPL device according to claim 2, wherein said non-smooth surface comprises circumferential grooves.

4. The IPL device according to claim 1, further comprising a reflective filter disposed on a surface of said light guide or a reflective coating disposed on a surface of said reflector, wherein said reflective filter or said reflective coating is made of a material which reflects part of a spectrum used for treatment of the area and absorbs a non-therapeutic part of said spectrum.

5. The IPL device according to claim 4, wherein said non-therapeutic part of said spectrum comprises ultraviolet electromagnetic wave energy.

6. The IPL device according to claim 4, wherein said non-therapeutic part of said spectrum comprises a part of a visible spectrum.

7. The IPL device according to claim 6, wherein said part of the visible spectrum is 400-550 nm.

8. The IPL device according to claim 4, wherein said material comprises gold or titanium nitride.

* * * * *